US006085546A

United States Patent [19]

Johnston

[11] Patent Number: 6,085,546

[45] Date of Patent: Jul. 11, 2000

[54] METHOD AND APPARATUS FOR THE PARTIAL CONVERSION OF NATURAL GAS TO LIQUID NATURAL GAS

[76] Inventor: Richard P. Johnston, 641 Joe Wheeler Brown Rd., Fulton, Miss. 38843

[21] Appl. No.: 09/157,026

[22] Filed: Sep. 18, 1998

[51] Int. Cl.[7] ..... F25J 1/00

[52] U.S. Cl. ..... 62/613; 62/619

[58] Field of Search ..... 62/611, 613, 619

[56] References Cited

U.S. PATENT DOCUMENTS

| | | | |
|---|---|---|---|
| 3,657,898 | 4/1972 | Ness et al. . | |
| 3,735,600 | 5/1973 | Dowdoll et al. . | |
| 3,818,714 | 6/1974 | Etzbach et al. . | |
| 3,837,172 | 9/1974 | Markbreiter et al. . | |
| 4,033,735 | 7/1977 | Swenson . | |
| 4,139,019 | 2/1979 | Bresie et al. . | |
| 4,213,476 | 7/1980 | Bresie et al. . | |
| 4,215,753 | 8/1980 | Champness . | |
| 4,359,871 | 11/1982 | Strass . | |
| 4,419,114 | 12/1983 | May et al. . | |
| 4,505,722 | 3/1985 | Shelton, Jr. . | |
| 4,566,886 | 1/1986 | Fabian et al. | 62/613 |
| 4,920,749 | 5/1990 | Letarte . | |
| 4,948,404 | 8/1990 | DeLong | 62/613 |
| 4,970,867 | 11/1990 | Herron et al. . | |
| 5,003,782 | 4/1991 | Kucerija . | |
| 5,036,671 | 8/1991 | Nelson et al. . | |
| 5,199,266 | 4/1993 | Johansen . | |
| 5,231,835 | 8/1993 | Beddome et al. . | |
| 5,287,703 | 2/1994 | Bernhard et al. . | |
| 5,755,114 | 5/1998 | Foglietta . | |

*Primary Examiner*—Ronald Capossela
*Attorney, Agent, or Firm*—Frost & Jacobs LLP

[57] ABSTRACT

A method and an apparatus for producing liquid natural gas (LNG) from a well head or other source of cool, high pressure natural gas. The natural gas from the source is purified and split into first and second flow portions. The first flow portion is split into two parts passing through first and second heat exchangers. The two parts are thereafter recombined and throttled into a LNG tank wherein part thereof flashes to liquid natural gas and a part thereof constitutes a very cold saturated vapor to be vented from the LNG tank. The vent remainder of the first flow portion is used as a coolant for the second heat exchanger and is then conveyed to a low pressure receiver such as a collection pipeline, the vent remainder having a pressure equal to or greater than the receiver. The second flow portion enters an expander wherein its pressure is lowered below that of the receiver and its temperature is lowered accordingly. The second flow portion is used as a coolant for the first heat exchanger and thereafter enters a compressor run by expander work wherein its pressure is raised to a level equal to or greater than that of the receiver. The second flow portion passes to the receiver. Under some conditions of pressure at the source and efficiency levels of the equipment used, the second heat exchanger can be eliminated and all of the first flow portion flashes to liquid natural gas, as is shown in the second embodiment of the present invention.

69 Claims, 3 Drawing Sheets

METHOD AND APPARATUS FOR THE PARTIAL CONVERSION OF NATURAL GAS TO LIQUID NATURAL GAS

REFERENCE TO RELATED APPLICATION

The present invention is related to co-pending application Ser. No. 90/157,025, filed Sep. 18, 1999, in the name of Richard P. Johnston and entitled A LIQUID NATURAL GAS SYSTEM WITH AN INTEGRATED ENGINE, COMPRESSOR AND EXPANDER ASSEMBLY; and co-pending application Ser. No. 09/157,149, filed Sep. 18, 1999, in the name of Richard P. Johnston and entitled A SIMPLE METHOD AND APPARATUS FOR THE PARTIAL CONVERSION OF NATURAL GAS TO LIQUID NATURAL GAS, the disclosure of each of which is incorporated herein by reference.

TECHNICAL FIELD

A method and an apparatus for a system of producing liquified natural gas, and more particularly to such a system which requires no external power source, and which is associated directly with a well head or other source of high pressure natural gas.

BACKGROUND ART

The present invention is based upon the discovery that a simple, efficient, open, partial conversion system for the production of liquid natural (LNG) can be provided if high pressure natural gas, taken directly from a well head or other appropriate source and cleaned (if required), is immediately thereafter split into two high pressure flow portions. The first high pressure flow portion is the source of the liquid natural gas fraction. The first flow portion is, itself, divided into two flow parts which are cooled in first and second heat exchangers, respectively, and then recombined. The recombined first flow portion is throttled into a liquid natural gas collector wherein a part of the first flow portion flashes to liquid natural gas. The gaseous remainder of the first flow portion within the liquid natural gas collector is used as a coolant for the second heat exchanger and is thereafter conducted to a receiver. The receiver may be of any appropriate type including a pipeline, the inlet of a gas turbine, the inlet of a chemical process, a burner head, a pump inlet, or the like. The vent remainder from the liquid natural gas tank is at a pressure equal to or slightly greater than the pressure within the receiver. The second flow portion is reduced in pressure in an expander to a pressure level less than that of the receiver to provide maximum cooling for the first heat exchanger to increase liquid natural gas production. Thereafter, the second flow portion is raised in pressure to a level equal to or greater than that of the receiver by a compressor run by work from the expander, and is introduced into the receiver.

Prior art workers have devised many types of partial conversion and total conversion systems for the production of liquid natural gas. This is exemplified in U.S. Pat. No. 3,735,600 where an open cycle is taught utilizing well head gas. In this system, however, once the well head gas has been purified, it is not immediately split into two flow portions. The arrangement of the equipment components differs from that of the present invention, as do the steps performed by the reference system.

Other prior art natural gas liquification systems are taught, for example, in U.S. Pat. No. 3,818,714 and U.S. Pat. No. 4,970,867, both of which are exemplary of the more complex prior art approaches.

DISCLOSURE OF THE INVENTION

According to the invention there is provided both a method and an apparatus for a system of producing liquid natural gas. The system is associated directly with a well head or other source which provides a supply of high pressure natural gas. Gas flow from the source is cleaned, unless the source provides natural gas clean enough to enable the formation of a liquid natural gas fraction, and thereafter is split into first and second high pressure flow portions. The first high pressure flow portion is again split into two flow parts which pass through first and second heat exchangers, respectively, wherein they are cooled. The first and second flow parts are thereafter rejoined. The recombined first flow portion is throttled into a liquid natural gas collector where part of the first flow portion flashes to liquid natural gas, the remaining gaseous portion constituting a cold, saturated natural gas vapor which is vented from the liquid natural gas collector.

This vent remainder of the first flow portion is used as a cooling medium for the second heat exchanger and is thereafter led to a receiver. The throttled vent remainder of the first flow portion is reduced in pressure to a level equal to or greater than the pressure in the receiver.

The second flow portion, upon being split from the first flow portion, passes through an expander where it is expanded and further cooled by work extraction. The second flow portion is reduced in the expander to a pressure below that of the receiver. From the expander, the second flow portion passes through the first heat exchanger serving as a cooling medium therefor. Thereafter, the second flow portion passes through a compressor driven by the above-noted expander work. The compressor raises the pressure level of second flow portion to a value equal to or greater than the pressure of the receiver to which the second flow portion is conducted. Allowing this second flow portion to drop to a lower pressure than that of the receiver, enables the second flow portion to achieve a lower temperature so that it causes the first flow portion to be cooled to a lower temperature than would otherwise be possible in the first heat exchanger. This ultimately results in a higher yield of the liquid natural gas in the collector therefor.

The compressor is driven by work extracted by the expander and requires no external power source. The provision of the compressor eliminates the limitation that the second flow portion cannot be reduced in pressure in the expander below a point where it can no longer be introduced into the receiver, since adequate pressure of the second flow portion can be restored by the compressor. This enhances the cooling effect of the expander.

Under some circumstances, the second heat exchanger can be eliminated, as will be set forth hereinafter.

DETAILED DESCRIPTION OF THE INVENTION

Figure 1:
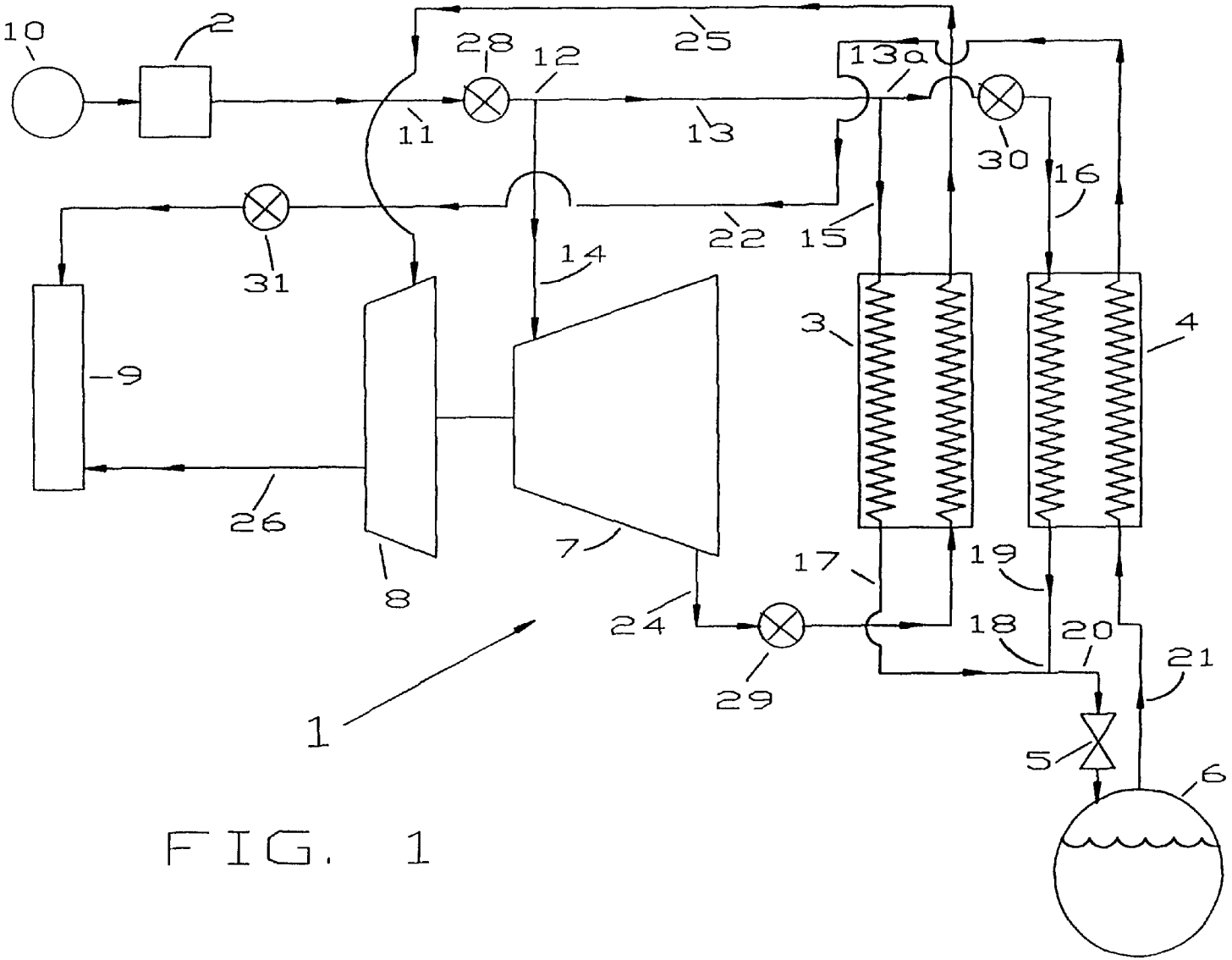
FIG. 1 is a simplified schematic representation of a first embodiment of the system of the present invention.

Reference is first made to FIG. 1, wherein a first embodiment of the invention is illustrated in diagrammatic form. The overall system is generally indicated at 1. The system comprises a purifier 2, a first heat exchanger 3, a second heat exchanger 4, a restrictor as, for example, a throttle valve 5, a liquid natural gas collector as, for example, a tank 6, an expander 7, a compressor 8, a receiver 9, and interconnecting conduits to be described. A well head or other appropriate source of cool, high-pressure natural gas is diagrammatically indicated at 10. In this embodiment it is assumed that purifier 2 is required. The high pressure flow from source 10 is conducted by conduit 11 through the purifier 2 to cleanse the flow from the source 10 of water, other liquids, carbon dioxide, nitrogen, heavier molecules and other unwanted constituents. Thereafter, the cleansed, high-pressure flow is conducted by conduit 11 to a point 12 where the flow is split into two portions. The split is determined by the pressure relationship between the source and the receiver, the properties of the liquid natural gas, optimization of the heat transfer process, and the thermodynamic efficiency of the components of the system. A part of the flow in conduit 11 passes through conduit 13 and is referred to as the first flow portion. The other part of the flow in conduit 11 passes through conduit 14 and is referred to herein as the second flow portion.

The first flow portion in conduit 13 is, itself, split into two parts, a first part of the first flow portion and a second part of the first flow portion. The first part of the first flow portion is caused to pass through heat exchanger 3 by conduit 15. The second flow part of the first flow portion is caused by conduit 16 to enter the second heat exchanger 4. The split of the first flow portion into two flow parts is set by heat exchange optimization and other factors. For a maximum performance heat exchange, two things must be true, First, the maximum cooling or heating temperature reached by the coolant or the LNG feedstock gas, permitted by the assumed heat exchanger effectiveness must be attained. Second, there must be just enough cooling or heating (BTU's) available on both sides of the heat exchanger so that the efficiency-limited temperatures can be reached. The split chosen between the two flow parts is set by matching exactly the cooling capability of the expander exhaust coolant for the first heat exchanger 3 and the cooling capacity of the LNG vent coolant in the second heat exchanger 4. Generally the feedstock parts passing through the heat exchangers 3 and 4 are not equal. Usually heat exchanger 3 passes much more flow than heat exchanger 4. Therefore, besides the source pressure and the component efficiencies, optimization of the heat exchanger performance determines the split at point 13*a*.

In embodiment 1, the coolants are at very different pressures and cannot be easily combined except at the receiver 9. Thus it is preferred to use two heat exchangers 3 and 4 in parallel rather than in series.

The first part of the first flow portion is directed from heat exchanger 3 by conduit 17 to a point 18. The second part of the first flow portion is conducted by conduit 19 from heat exchanger 4 to point 18. At point 18, the first and second parts of the first flow portion are reunited and the recombined first flow portion is conducted by conduit 20 to a restriction 5. It will be understood that the first and second heat exchangers 3 and 4 will each constitute any appropriate type of heat exchanger. Excellent results are achieved when heat exchangers 3 and 4 are of the cross-counter flow type, as is well known in the art.

Figure 2:
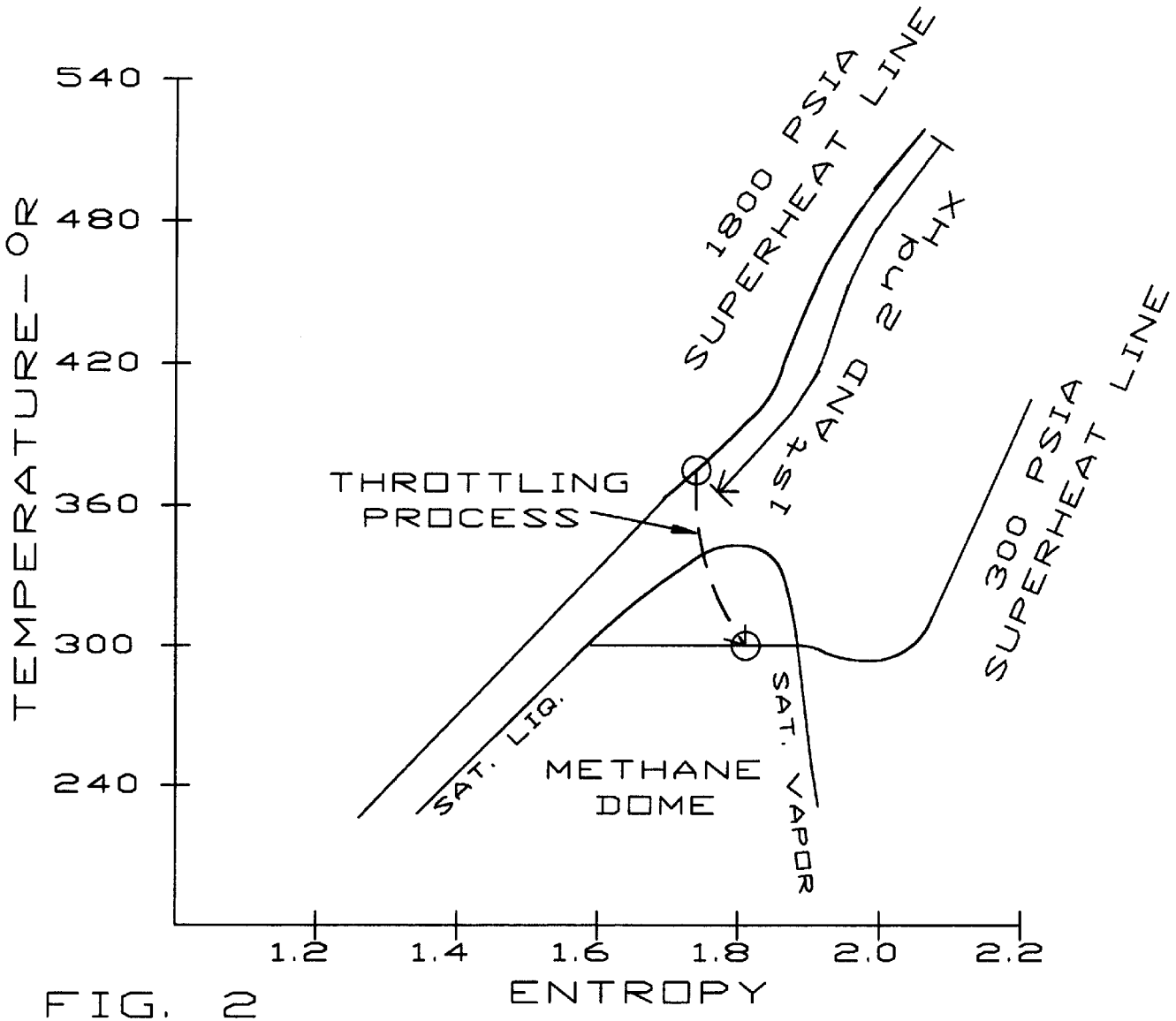
FIG. 2 is a generic methane liquefaction diagram for the described process.

The recombined first flow portion is passed through restriction 5. Excellent results are achieved using a throttle valve for restriction 5. Throttle valve 5 throttles the first flow portion into the liquid natural gas tank 6. The first flow portion is throttled by throttle valve 5 to a pressure low enough to pass through the saturated liquid/vapor dome as shown in the methane liquification diagram of FIG. 2. Part of the first natural gas portion flashes to liquid natural gas. The unliquified vent remainder of the first flow portion constitutes a very cold, saturated, natural gas vapor at a sufficient pressure that it can be directed by conduit 21 to heat exchanger 4, wherein the vent remainder of the first flow portion serves as a cooling medium for heat exchanger 4. The vent remainder of the first flow portion, having served as a cooling medium for heat exchanger 4, is conducted by conduit 22 to receiver 9. As indicated above, the receiver can constitute any appropriate receiving means. For purposes of an exemplary showing, it may be considered to be a collection pipeline. It will be understood that the pressure of the vented remainder of the first flow portion in tank 6 must be equal to or somewhat greater than the pressure in receiver 9 and throttle valve 5 must be set to assure this.

A pressure regulator 31 is preferably located in line 22. Pressure regulator 31 maintains the pressure in tank 6 at the required level while it is being filled or if there is some variation in the desired LNG pressure level. When process vent flow occurs, the regulator restriction maintains the pre-set tank pressure level. Even when there is no process vent flow, as in system 27, the tank pressure level must be kept constant so that the throttling process proceeds as desired.

It will be noted that line 22 is connected to the receiver 9. Even with 100% conversion, the pressure in tank 6 must be controlled as the tank is filled. The system dynamics are such that if the tank 6 went to a lower pressure, or there was some heat conducted into the tank 6, some saturated vapor would always be driven off so that the desired pressure of tank 6 would be maintained.

The second flow portion from conduit 11 enters conduit 14 at point 12 and is led thereby to expander 7 wherein both its pressure and temperature are reduced as work is extracted. The expander 7 may be of any appropriate type such as a positive displacement piston expander, a turbo expander, or a radial vane expander, all of which are known in the art. From expander 7, the second flow portion is directed by conduit 24 to the first heat exchanger 3 wherein it serves as a cooling medium. From heat exchanger 3, the second flow portion is directed by conduit 25 to compressor 8. From compressor 8, the second flow portion is conducted by conduit 26 to receiver 9.

In the system 1 of FIG. 1, the pressure level to which the second flow portion can be reduced in expander 7 is not limited to a pressure equal to or slightly greater than the pressure at the receiver 9, as is the pressure level of the vent remainder of the first flow portion in tank 6 which must be at a pressure high enough to enable it to enter receiver 9. This is true because, once the second flow portion from expander 7 passes through heat exchanger 3, it is directed by conduit 25 to compressor 8 wherein its pressure may be raised to the proper level at which it can be introduced into receiver 9 via conduit 26. Compressor 8 can be of any appropriate type such as, for example, a radial vane compressor, a positive displacement piston compressor, a turbo compressor, or the like. Since a lower exhaust pressure of the second flow portion can be achieved in expander 7, the amount of work that can be removed is greater and thus the temperature of the second flow portion from expander 7 will be lower, enabling greater cooling of the first part of the first flow portion in heat exchanger 3 than would otherwise be possible. The end result is a greater yield of liquid natural gas in tank 6 under similar source parameters and component efficiency levels, than for the case where the expander exhaust and all coolant flows must be at a pressure equal to or greater than that of the receiver.

It will be understood by one skilled in the art that the amount of liquid natural gas produced is a function of the equipment efficiency, the initial well head or other source gas conditions (temperature and pressure) and the like. For example, while not necessarily so limited, pressures frequently encountered at the well head are above 1,000 PSIA. To describe the operation of system 1 of FIG. 1, exemplary but non-limiting conditions of temperature and pressure will be set forth.

In the operation of system 1 of FIG. 1, it will be assumed that the natural gas at source 10 has a pressure of 1500 psia, and a temperature of 70° F. (530° R.). The expander adiabatic efficiency is about 80 percent and the heat exchanger effectiveness is assumed to be 0.90. the compressor has an adiabatic efficiency of about 75 percent. At point 12, the natural gas stream in conduit 11 is split into the first flow portion received in conduit 13 and the second flow portion received in conduit 14. The first flow portion is about 35% of the flow in conduit 11, and the second flow portion is about 65% of the flow in conduit 11. The first flow portion passes through conduit 13 and is split at point 13A into a first part entering conduit 15 and a second part entering conduit 16. The first part of the first flow portion in conduit 15 is about 32% of the flow in conduit 11. The second part of the first flow portion in conduit 16 is about 3% of the first flow portion in conduit 11. This flow split is set by heat exchanger optimization considerations. Conduit 15 leads the first part of the first flow portion through heat exchanger 3 to conduit 17 and point 18. The second part of the first flow portion in conduit 16 passes through heat exchanger 4 and via conduit 19 to point 18. At point 18, the first and second parts of the first flow portion are reunited and are directed to throttle valve 5 by conduit 20. The first part of the first flow portion arrives at point 18 at a temperature of about minus 131° F. (329° R.). The second part of the first flow portion arrives at point 18 via conduit 19 at a temperature of about minus 137° F. (323° R.). Both the first and second parts arrive at point 18 at 1500 psia and the recombined first flow portion in conduit 20 maintains the 1500 psia pressure until it reaches throttle valve 5. The temperature of the recombined first flow portion in conduit 20 is minus 132° F. (328° R.). The first flow portion, having passed through throttle valve 5, enters the liquid natural gas tank 6 wherein approximately 29% of the total flow from source 10 flashes to liquid natural gas at 300 psia. From heat exchanger 4, the vent remainder of the first flow portion is conducted by conduit 22 to receiver 9 at a pressure of about 300 psia and a temperature of about 47° F. (507° R.). It will be assumed that the receiver is at a pressure of approximately 300 psia.

The second flow portion in conduit 14 will have the well head pressure of about 1500 psia and the well head temperature of 70° F. (530° R.). This pressure and temperature will remain until the second flow portion reaches expander 7. The second flow portion exits the expander at a pressure of about 130 psia and a temperature of about minus 153° F. (307° R.). Once the second flow portion passes through heat exchanger 3, it will have a temperature of about 48° F. (508° R.), and it will maintain the pressure of about 130 psia. The second flow portion enters the compressor from conduit 25. It exits the compressor at a pressure of about 300 psia and a temperature of about 192° F. (652° R.).

As indicated above, about 29% of the total flow from source 10 will be converted to liquid natural gas and 71% of the flow from source 10 will exit the system via receiver 9. It is assumed that the effectiveness of the first and second heat exchangers are about 0.90 each, the adiabatic efficiency of the expander is about 80% and the adiabatic efficiency of the compressor is about 75%. For purposes of comparison, if all of the component efficiencies were the same as above, but the expander's exhaust pressure was only dropped to a value at least equal to pipeline pressure, only about 22% of the flow from the source 10 would be converted to liquid natural gas.

From the above, it will be noted that a greater yield of liquid natural gas than would otherwise be possible is achieved, and still no outside energy source is required, other than the well head or source, itself, since the compressor 8 is driven by the work output of expander 7. It will be understood that system 1 makes use of the Joule-Thompson Refrigerator Principle. Specifically, the very cold saturated vapor return from tank 6 goes back through heat exchanger 4 to reduce the incoming first flow portion temperature to a sufficiently low level that it can be partially condensed directly to liquid natural gas after passing through the restrictor or throttle valve 5. A further cooling benefit is derived from the second flow portion which is lowered in expander 4 to a pressure level below the pressure level of receiver 9 for extra cooling, since the pressure of the second flow portion can be restored to a level at least equal to that of the receiver by compressor 8.

Figure 3:
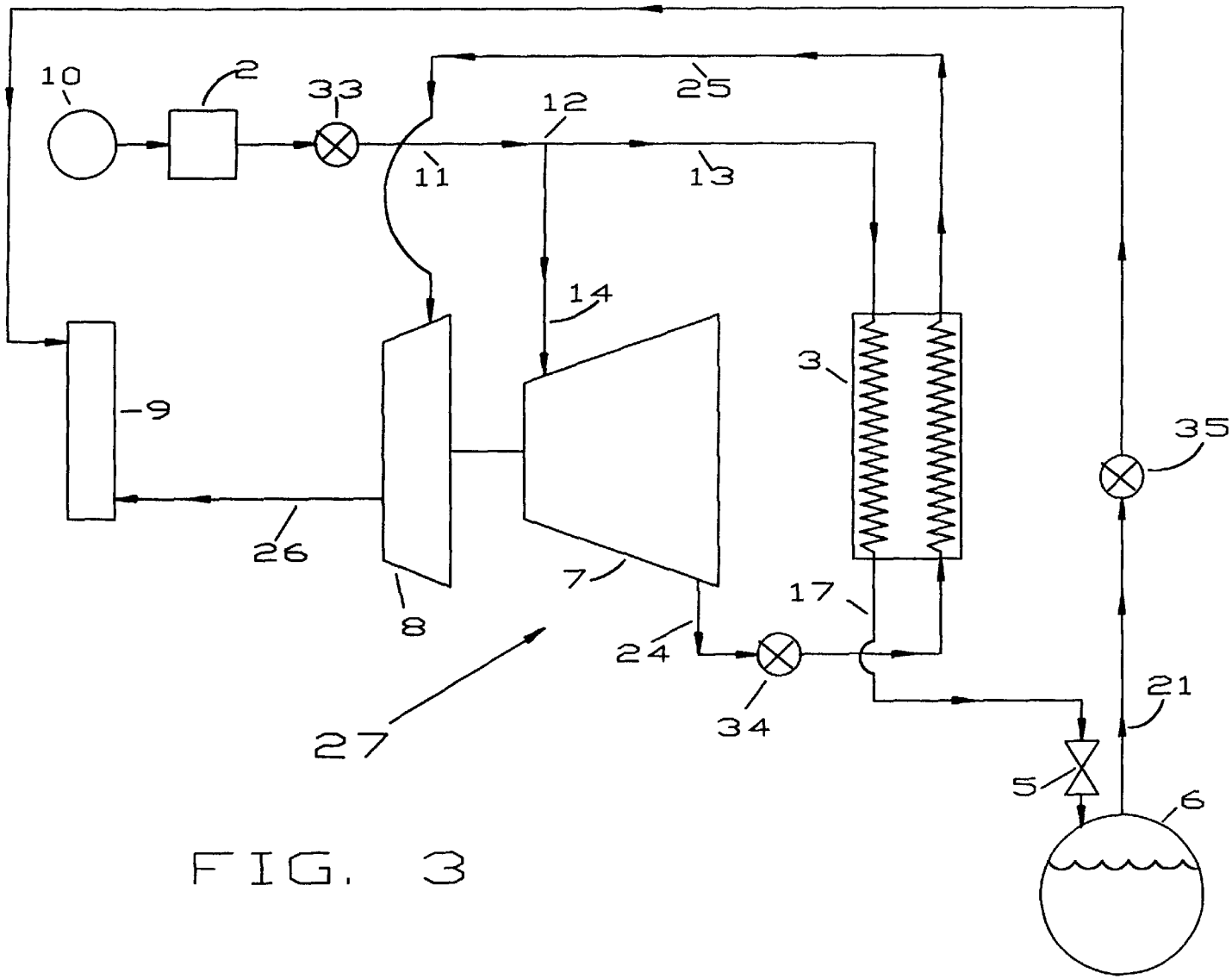
FIG. 3 is a simplified schematic representation of a second embodiment of the system of the present invention.

Under some circumstances, it has been found that one of the heat exchangers can be eliminated. Such a system is generally indicated at 27 in FIG. 3. In FIG. 3, like parts have been given like index numerals. In this embodiment, the apparatus comprises a purifier 2, a single heat exchanger 3, a restriction in the form of a throttle valve 5, a liquid natural gas collector in the form of a tank 6, an expander 7, a compressor 8, a receiver 9, and connecting conduits.

In this embodiment, the source 10 can be any appropriate source capable of providing cool, high pressure natural gas above a certain pressure level. A prime example of such a source is a well head. The source is connected by conduit 11 to a purifier which serves the same purpose as the purifier 2 of FIG. 1. Conduit 11 leads to point 12 where the flow from source 10 is divided into a first flow portion in conduit 13 and a second flow portion in conduit 14. The first flow portion is directed by conduit 13 to a heat exchanger 3 which may be of the same type described with respect to FIG. 1. The first flow portion exits heat exchanger 3 via conduit 17 which directs the first flow portion to throttle valve 5. The first flow portion is throttled by throttle valve 5 into liquid natural gas tank 6. The first flow portion is throttled by valve 5 to a pressure low enough to pass through the saturated liquid/vapor dome as shown in the methane liquification diagram of FIG. 2. At the stated pressure of the source and at the performance levels of the components as discussed hereinafter, the entire first flow portion flashes to liquid natural gas in tank 5. Therefore, there is no process vent flow in conduit 21, except to control the pressure in tank 6.

In the embodiment 27 of FIG. 3, as the source pressure increases above 2100 psia, the total yield percentage of liquid natural gas will increase with corresponding change in operating pressure and temperature and no process vent flow production.

The second flow portion in conduit 14 is led thereby to expander 7 wherein it is reduced in pressure and temperature. The cooled and expanded second flow portion is directed by conduit 24 to heat exchanger 3 wherein it serves as a cooling medium therefor. From the heat exchanger 3, the expanded and warmed second flow portion is carried by conduit 25 to compressor 8 wherein the second flow portion is raised in temperature and pressurized to the extent that it will enter receiver 9 via conduit 26. Again, expander 7 can be of any of the types outlined above. In embodiment 27 of FIG. 3, there is no vent remainder of the first flow portion which must be directed to receiver 9 except to control the working pressure in tank 6. Again, in this embodiment, the pressure level to which the second flow portion can be reduced in expander 7 is not limited to a pressure equal to or slightly greater than the receiver pressure. This is true because, once the second flow portion from expander 7 passes through heat exchanger 3, it is directed by conduit 25 to compressor 8 wherein its pressure is raised to the proper level at which it can be introduced into receiver 9 via conduit 26. As in the first embodiment, since a lower pressure of the second flow portion can be achieved in expander 7 in the embodiment of 27 of FIG. 3, greater cooling of the first flow portion in heat exchanger 3 can be achieved than would otherwise be possible. The end result is a greater yield of liquid natural gas in tank 6 which, in this embodiment, is about 35% of the flow from the source (i.e. all of the first flow portion). In the operation of the embodiment or system 27 of FIG. 3, it will be assumed that heat exchanger 3 has an effectiveness of 0.90, expander 7 has an adiabatic efficiency of 80%, compressor 8 has an adiabatic efficiency of 75% and the natural gas from source 10 has a pressure of 2100 psia and a temperature of 70° F. (530° R.). It will be understood that the first flow portion of the natural gas from the source maintains its 2100 psia level until it reaches throttle valve 5. At point 12, flow from source 10 is split into the first flow portion and the second flow portion. The first flow portion in conduit 13 will constitute about 35% of the flow from the source.

The second flow portion will constitute about 65% of the flow from the source. The first flow portion passes through heat exchanger 3 and drops in temperature from 70° F. (530° R.) to about −160° F. (300° R.). As indicated above, in the liquid natural gas tank 6, 100% of the first flow portion will flash to liquid natural gas.

The second flow portion in conduit 14 will enter expander 7 at 2100 psia and 70° F. (530° R.). As the second flow portion exits expander 7 via conduit 24, it will have a pressure of about 125 psia and a temperature of −185° F. (275° R.). After the second flow portion from expander 7 has served as the cooling medium for heat exchanger 3, it will have a pressure of about 125 psia and a temperature of about 45° F. (505° R.). In compressor 8, the second flow portion will achieve a pressure of 300 psia and a temperature of 194° F. (654° R.). It will be assumed that the receiver's pressure is 300 psia so that the second flow portion can be introduced from compressor 8 to receiver 9 via conduit 26.

As in the case of the first embodiment, the parameters of temperature, pressure and the like given above are exemplary only. These parameters will change depending upon the temperature and pressure of the well head, the nature of the receiver, the efficiency of the equipment and other related factors. To adjust these parameters to maximize the production of liquid natural gas is well within the skill of the worker in the art.

Suitable pressures and temperatures for the processing of liquid natural gas (LNG) derive from the fact that for methane the upper critical pressure and temperature are about 667.06 psia and −117.01° F. (342.99° R.). The lower critical pressure and temperature are about 1.694 psia and −296.8° F. (163.2° R.). Therefore, the LNG processing tank pressure must be below 667.06 psia and above 1.694 psia. It will be remembered that the receiver pressure must be equal to or less than the vent exhaust pressure being received.

As described above, the maintenance of proper flows and pressure levels throughout the embodiments of the process system of the present invention depended entirely on the existence of stable inlet and exhaust pressures and flows. This stability requirement can be alleviated to some extent by the judicious placement of inlet, exhaust and expander exhaust pressure regulators. These regulators can be used to eliminate the process variability due to uncontrolled upstream and downstream pressure fluctuations. A regulator 28 may be located just before split point 12 as shown in FIG. 1. The regulator 29 just downstream of the expander exhaust can maintain the desired flow split between expander process and the heat exchangers. A regulator 30 in conduit 16 can maintain the desired flow split between lines 15 and 16. An additional regulator 31 can be located in conduit 22 leading to receiver 9 to ensure that the pressure of the vent remainder as it leaves tank 6 is at an appropriate level. The restrictor 5, just upstream of LNG collector or tank 6, can be fixed or variable. If variable, it can be used to regulate process pressure drops more accurately without depending completely on feedstock flow rate. This would allow some ability to rematch the process equipment to changes in source flow and pressure and receiver pressure changes. These regulations are not needed in an ideal supply/exhaust situation, but would be most helpful to maintain near optimum matching for all the flow equipment as small changes due to wear and tear, blockage and degradation of expander and heat exchanger performance levels.

In embodiment 1, the coolants are at very different pressures and cannot be easily combined except at the receiver 9. Thus, it is preferred to use two heat exchangers 3 and 4 in parallel rather than in series. In FIG. 3 regulators 33 and 34, equivalent to regulators 28 and 29 of FIG. 1 are shown and serve the same purpose as regulators 28 and 29. Once again restrictor 5 can be variable for the same reasons given for restrictor 6 of FIG. 1.

Referring to FIG. 3, a pressure regulator 35 is preferably located in line 21. Pressure regulator 35 maintains the pressure in tank 6 at the required level while it is being filled or if there is some variation in the desired LNG pressure level. Pressure regulator 35 maintains the pressure in tank 6 at 300 psia. When process vent flow occurs, the regulator restriction maintains the pre-set tank pressure level. Even when there is no process vent flow, such as for system 27, the tank pressure level must be kept constant so that the throttling process remains stable and the LNG temperature and boiling point are maintained.

It will be noted that line 21 is connected to the receiver 9. Even with 100% conversion, the pressure in tank 6 must be controlled as the tank is filled. The system dynamics are such that if the tank 6 went to a lower pressure, or there was some heat conducted into the tank 6, some saturated vapor would always be driven off so that the desired pressure of the tank 6 would be maintained.

From the above it will be apparent that the added regulators are desirable to modify flow and pressure throughout the systems to maintain design levels of pressure and flow. This must be done for efficient operation in the face of variations in upstream supply and downstream exhaust conditions along with the inevitable change in system component performance, due to wear and tear, blockage and deposit accumulations, and the like.

When purification of the gas is required, this can be accomplished in a number of ways. First of all, purifier equipment could be located in conduit 11 to thoroughly clean the source flow before it is split at 12. This is shown in FIGS. 1 and 3. Another approach in both embodiments would be to locate purifier equipment in conduit 11 to partially purify the source flow to remove any impurities which might clog the apparatus. A second and more thorough purifier treatment can be applied to the first flow portion in conduit 13 to remove those impurities which would interfere with the formation of liquid natural gas. Alternatively, it would be possible to apply a thorough purifier treatment to the first flow portion (from which the liquid natural gas is derived) in conduit 13, and to subject the second flow portion to a lesser purifying treatment in conduit 14, primarily removing those impurities which might clog the apparatus.

Although the invention has been described in terms of natural gas, it is applicable to the liquification of other appropriate gases.

Modifications may be made in the invention without departing from the spirit of it.

What is claimed:

1. A method for converting a fraction of natural gas from a source to liquid natural gas comprising the steps of providing a source of cool, pressurized, clean natural gas, heat exchange equipment, a restrictor, a liquid natural gas collector, an expander, a compressor and a low pressure receiver, splitting said purified natural gas from said source into first and second flow portions, causing said first flow portion to be cooled by said heat exchange equipment, causing said first flow portion to pass through said restrictor into said liquid natural gas collector wherein at least a part of said first flow portion flashes to liquid natural gas, conveying said second flow portion to said expander, expanding said second flow portion to lower the pressure thereof below said pressure of said receiver with resultant lowering of the temperature of said second portion, conveying said cooled second flow portion to said heat exchange equipment as a cooling medium therefor, directing said second flow portion from said heat exchange equipment to said compressor, running said compressor by expander work, raising the pressure of said second flow portion above the pressure of said receiver conducting said second flow portion from said compressor to said receiver.

2. The method claimed in claim 1 wherein said heat exchange equipment comprises first and second heat exchangers, dividing said first flow portion into first and second flow parts, causing said first part to pass through said first heat exchanger and said second flow part to pass through said second heat exchanger, reuniting said first and second parts of said first flow portion ahead of said restrictor, reducing said pressure of said first flow portion in said restrictor to a value at least equal to said pressure in said receiver, a remainder of said first flow portion in said liquid natural gas collector comprising a very cold saturated natural gas portion to be vented from said tank, conducting said vent portion to said second heat exchanger, using said vent portion as a cooling medium for said second heat exchanger and conducting said vent portion of said first flow portion to said receiver, using said second flow portion from said expander as a cooling medium for said first heat exchanger prior to conducting said second flow portion to said compressor.

3. The method claimed in claim 2 wherein said restriction comprises a throttle valve.

4. The method claimed in claim 2 wherein said collector is a liquid natural gas tank.

5. The method claimed in claim 2 wherein said first and second heat exchangers are of the cross-counter flow type.

6. The method claimed in claim 2 including the step of determining the split of said natural gas from said source into said first and second flow portions by the pressure relationship between said source and said receiver, by the properties of the liquid natural gas, by optimization of the heat exchange process and by the thermodynamic efficiency of said first and second heat exchangers and said expander and said compressor.

7. The method claimed in claim 2 wherein said expander comprises a positive displacement piston expander, a turbo expander, or a radial vane expander.

8. The method claimed in claim 2 wherein said receiver is a pipeline.

9. The method claimed in claim 2 wherein said receiver comprises a gas pipeline, the inlet of a gas turbine, or the inlet of a chemical process, a burner head or a pump inlet.

10. The method claimed in claim 2 wherein said source of said natural gas comprises a well head.

11. The method claimed in claim 2 including the steps of providing a purifier immediately following said source and removing from said source gas both water and other liquids, heavier molecules and other unwanted constituents therefrom.

12. The method claimed in claim 2 including the step of determining the split of said first flow portion into two flow parts based upon source pressure, component efficiencies, and optimization of heat exchanger performance.

13. The method claimed in claim 1 wherein said heat exchange equipment comprises a single heat exchanger, cooling said first flow portion by causing said first flow portion to pass through said single heat exchanger to said restrictor, conveying said second flow portion from said expander to said single heat exchanger to serve as a cooling medium therefor to cool said first flow portion conveying said second flow portion from said single heat exchanger to said compressor, said source having a pressure level, and said single heat exchanger, said compressor and said restrictor and said expander having performance levels such that all of said first flow portion flashes to liquid natural gas in said tank.

14. The method claimed in claim 13 including the step of determining the split into first and second portions of said natural gas from said source by the pressure relationship between said source and said receiver, by the properties of the liquid natural gas, by optimization of the heat exchange process and by the thermodynamic efficiency of said single heat exchanger, said expander, and said compressor.

15. The method claimed in claim 13 wherein said single heat exchanger is of the cross-counter flow type.

16. The method claimed in claim 13 wherein said expander comprises a positive displacement piston expander, a turbo expander, or a radial vane expander.

17. The method claimed in claim 13 wherein said receiver is a pipeline.

18. The method claimed in claim 13 wherein said receiver comprises a pipeline, the inlet of a gas turbine, or the inlet of a chemical process, a pump inlet or a burner head.

19. The method claimed in claim 13 wherein said source of said natural gas comprises a well head.

20. The apparatus claimed in claim 19 wherein said expander comprises a positive displacement piston expander, a turbo expander, or a radial vane expander.

21. The apparatus claimed in claim 19 wherein said receiver is a pipeline.

22. The apparatus claimed in claim 19 wherein said receiver comprises a pipeline, the inlet of a gas turbine, or the inlet of a chemical process.

23. The apparatus claimed in claim 19 wherein said source of natural gas comprises a well head.

24. The method claimed in claim 13 wherein said restrictor comprises a throttle valve.

25. The method claimed in claim 13 wherein said collector is a liquid natural gas tank.

26. The method claimed in claim 13 including the steps of providing a purifier immediately following said source and removing from said source gas both water and other liquids, heavier molecules and other unwanted constituents therefrom.

27. The method claimed in claim 13 including the steps of modifying flow and pressure at various points in said method to maintain design levels of pressure and flow.

28. An apparatus for converting a fraction of the natural gas from a supply thereof to a liquid natural gas, said apparatus comprising a source of cool, pressurized, clean natural gas, heat exchange equipment, a restrictor, a natural gas collector, an expander, a compressor and a low pressure receiver, said natural gas supply being connected to a point where said natural gas is split into first and second flow portions, a conduit for each of said first and second flow portions, said conduit for said first flow portion being connected to said heat exchange equipment, said heat exchange equipment being connected to said restrictor, said restrictor being connected to said collector whereby said first flow portion of said natural gas is cooled by said heat exchanger and passes through said restrictor into said tank wherein at least a part of said first flow portion flashes to liquid natural gas, said collector being operatively connected to said receiver, said conduit for said second flow portion being connected to said expander and said expander being connected to said heat exchange equipment whereby said second flow portion is expanded to a pressure below that of said receiver with resultant cooling of said second flow portion and said second flow portion serves as a cooling medium for said heat exchange equipment, said compressor being driven by expander work, said heat exchange equipment being connected to said compressor and said compressor being connected to said receiver, whereby said second flow portion from said heat exchange equipment is compressed to a pressure at least equal to that of said receiver and is conveyed from said compressor to said receiver.

29. The apparatus claimed in claim 28 wherein said heat exchange equipment comprises first and second heat exchangers, said conduit for said first flow portion being connected to a point where said first flow portion is divided into first and second flow parts, first and second conduits for said first and second flow parts respectively, said first and second conduits being connected to said point where said first flow portion is divided, said conduit for said first flow part being connected to said first heat exchanger, said conduit for said second flow part being connected to said second heat exchanger, whereby said first and second flow parts pass through said first and second heat exchangers respectively, said first and second heat exchangers each having an outlet connected to a conduit leading to said restrictor whereby said first and second flow parts of said first flow portion are reunited before passing through said restrictor, said collector containing a remainder of said first flow portion which did not flash to liquid and which comprises a very cold saturated natural gas at a pressure at least as great as that in said receiver, said tank being connected to said second heat exchanger and thence to said receiver whereby said vent remainder of said first flow portion serves as a cooling medium for said second heat exchanger and is thereafter directed to said receiver, said expander being connected to said first heat exchanger and said first heat exchanger being connected to said compressor whereby said expanded and cooled second flow portion serves as a cooling medium for said first heat exchanger prior to entering said compressor.

30. The apparatus claimed in claim 29 wherein said restrictor comprises a throttle valve.

31. The apparatus claimed in claim 29 wherein said collector is a liquid natural gas tank.

32. The apparatus claimed in claim 29 including a purifier immediately following said source for removing water, other liquids, heavier molecules and other unwanted constituents from said natural gas from said source.

33. The apparatus claimed in claim 29 wherein said heat exchangers are of the cross-counter flow type.

34. The apparatus claimed in claim 29 wherein said expander comprises a positive displacement piston expander, a turbo expander or a radial vane expander.

35. The apparatus claimed in claim 29 wherein said receiver is a pipeline.

36. Th e apparatus claimed in claim 29 wherein said receiver comprises a pipeline, the inlet of a gas turbine or the inlet of a chemical process, a pump inlet or a burner head.

37. The apparatus claimed in claim 29 wherein said source of natural gas comprises a well head.

38. The apparatus claimed in claim 28 wherein said heat exchange equipment comprises a single heat exchanger, said conduit for said first flow portion being connected to said single heat exchanger and said single heat exchanger being connected to said restrictor whereby said first flow portion is cooled in said single heat exchanger prior to passage through said restrictor into said collector, said expander being connected to said single heat exchanger and said single heat exchanger being connected to said compressor whereby said second flow portion serves as a cooling medium for said single heat exchanger before entering said compressor, said source having a pressure level such that, said single heat exchanger, said throttle valve and said expander having performance levels such that all of said first flow portion flashes to liquid natural gas.

39. The apparatus claimed in claim 38 wherein said single heat exchanger is of the cross-counter flow type.

40. The apparatus claimed in claim 38 wherein said restrictor comprises a throttle valve.

41. The apparatus claimed in claim 38 wherein said collector is a liquid natural gas tank.

42. The apparatus claimed in claim 38 including a purifier immediately following said source for removing water, other liquids, heavier molecules and other unwanted constituents from said natural gas from said source.

43. The method claimed in claim 2 including the steps of modifying flow and pressure at various points in said method to maintain design levels of pressure and flow.

44. The apparatus claimed in claim 29 including a number of regulators added to said apparatus to regulate and modify flow and pressure at various points in said apparatus to maintain design levels of pressure and flow.

45. The apparatus claimed in claim 38 including a number of regulators added to said apparatus to regulate and modify flow and pressure at various points in said apparatus to maintain design levels of pressure and flow.

46. A method for converting a fraction of natural gas from a source to liquid natural gas, comprising the steps of:

a. providing a flow of pressurized natural gas having an initial pressure;

b. passing a first portion of said flow through at least a first heat exchanger to cool said first portion of said flow;

c. reducing the pressure of said first portion of said flow thereby flashing a first part of said first portion of said flow to liquid natural gas, leaving a second part of said first portion of said flow which comprises a saturated natural gas;

d. passing a second portion of said flow through at least a second heat exchanger to cool said second portion of said flow;

e. reducing the pressure of said second portion of said flow thereby flashing a first part of said second portion of said flow to liquid natural gas, leaving a second part of said second portion of said flow which comprises a saturated natural gas;

f. passing at least part of at least one of said second part of said first portion of said flow and said second part of said second portion of said flow through said at least a second heat exchanger to serve as a cooling medium therefor;

g. reducing the pressure of a third portion of said flow thereby cooling said third portion of said flow; and h. passing said third portion of said flow through said at least a first heat exchanger to serve as a cooling medium therefor.

47. The method as claimed in claim 46 including the step of increasing the pressure of said third portion of said flow after it has passed through said at least first heat exchanger.

48. The method as claimed in claim 47 wherein work is extracted from said third portion of said flow during the step of reducing the pressure of said third portion of said flow, and wherein said work is used to increase the pressure of said third portion of said flow during the step of increasing the pressure of said third portion of said flow after it has passed through said at least first heat exchanger.

49. The method as claimed in claim 47 wherein the step of increasing the pressure of said third portion of said flow includes increasing the pressure of said third portion of said flow to a pressure which is approximately equal to the respective pressure of at least one of said second part of said first portion of said flow and said second part of said second portion of said flow.

50. The method as claimed in claim 46, 47, or 48 wherein said step of reducing the pressure of said third portion of said flow comprises passing said third portion of said flow through an expander.

51. The method as claimed in claim 50 wherein said expander comprises a positive displacement piston expander, a turbo expander, or a radial vane expander.

52. The method as claimed in claim 46 comprising the step of combining said first portion of said flow with said second portion of said flow prior to the step of reducing the pressure of said first portion of said flow thereby flashing a first part of said first portion of said flow to liquid natural gas and prior to the step of reducing the pressure of said second portion of said flow thereby flashing a first part of said second portion of said flow to liquid natural gas.

53. The method as claimed in claim 46 comprising the step of combining said second part of said first portion of said flow with said second part of said second portion of said flow.

54. The method as claimed in claim 53 wherein said second part of said first portion of said flow with said second part of said second portion of said flow are combined subsequent to the step of passing at least part of at least one of said second part of said first portion of said flow and said second part of said second portion of said flow through said at least second heat exchanger.

55. The method as claimed in claim 46, 47, 48, 52, or 53, wherein at least one of said step of reducing the pressure of said first portion of said flow and said step of reducing the pressure of said second portion of said flow includes using a throttle valve to reduce the pressure.

56. The method as claimed in claim 46, 47, 48, 52, or 53, including the step of determining respective flow rates of said first, second and third portions of said flow a. by the relationship between the initial pressure of said flow and the respective pressures of said second parts of said first and second portions of said flow, b. by the properties of the liquid natural gas, c. by optimization of the heat exchange process, and d. by the thermodynamic efficiency of said heat exchangers and of said step of reducing the pressure of said third portion of said flow.

57. The method as claimed in claim 47, 48, 52 or 53, including the step of determining respective flow rates of said first, second and third portions of said flow a. by the relationship between the initial pressure of said flow and the respective pressures of said second parts of said first and second portions of said flow, b. by the properties of the liquid natural gas, c. by optimization of the heat exchange process, and d. by the thermodynamic efficiency of said heat exchangers, said step of reducing the pressure of said third portion of said flow, and the step of increasing the pressure of said third portion of said flow.

58. The method as claimed in claim 46, 47, 48, 52, or 53 comprising the step of passing at least one of said second parts of said first and second portions to a pipeline subsequent to second parts respectively passing through said first and second heat exchangers.

59. The method as claimed in claim 46, 47, 48, 52, or 53 including the step of removing unwanted constituents from said flow of pressurized natural gas.

60. A method for converting a fraction of natural gas from a source to liquid natural gas, comprising the steps of:

a. providing a flow of pressurized natural gas having an initial pressure;

b. passing a first portion of said flow through at least a first heat exchanger to cool said first portion of said flow;

c. reducing the pressure of said first portion of said flow thereby flashing a first part of said first portion of said flow to liquid natural gas, leaving a second part of said first portion of said flow which comprises a saturated natural gas;

d. reducing the pressure of a second portion of said flow thereby cooling said second portion of said flow;

e. passing at least part of said second portion of said flow through said at least first heat exchanger to serve as a cooling medium therefor;

f. increasing the pressure of at least a portion of said second portion of said flow after it has passed through said at least first heat exchanger.

61. The method as claimed in claim 60 wherein work is extracted from said second portion of said flow during the step of reducing the pressure of said second portion of said flow, and wherein said work is used to increase the pressure of said second portion of said flow during the step of increasing the pressure of at least a portion of said second portion of said flow after it has passed through said at least first heat exchanger.

62. The method as claimed in claim 60 wherein the step of increasing the pressure of said second portion of said flow includes increasing the pressure of said second portion of said flow to a pressure which is approximately equal to the pressure said second part of said first portion of said flow.

63. The method as claimed in claim 60, 61, or 62 wherein said step of reducing the pressure of said second portion of said flow comprises passing said second portion of said flow through an expander.

64. The method as claimed in claim 63 wherein said expander comprises a positive displacement piston expander, a turbo expander, or a radial vane expander.

65. The method as claimed in claim 60, 61 or 62 wherein said second part of said first portion is combined with said second portion subsequent to the step of increasing the pressure of said second portion of said flow.

66. The method as claimed in claim 60, 61, 62, or 65 wherein said step of reducing the pressure of said first portion of said flow includes using a throttle valve to reduce the pressure.

67. The method as claimed in claim 60, 61, 62, or 65 including the step of determining respective flow rates of said first, second and third portions of said flow a. by the relationship between the initial pressure of said flow, the pressure of said second part of said first portion of said flow and the pressure of said at least a portion of second portion of said flow subsequent to the step of increasing the pressure of at least a portion of said second portion of said flow, b. by the properties of the liquid natural gas, c. by optimization of the heat exchange process, and d. by the thermodynamic efficiency of said heat exchanger and of said step of reducing the pressure of said second portion of said flow.

68. The method as claimed in claim 60, 61, 62, or 65 comprising the step of passing at least one of said second part of said first portion of said flow and said at least a portion of second portion of said flow subsequent to the step of increasing the pressure of at least a portion of said second portion of said flow to a pipeline.

69. The method as claimed in claim 60, 61, 62, or 65 including the step of removing unwanted constituents from said flow of pressurized natural gas.

* * * * *